US005890954A

United States Patent [19]

Barous

[11] Patent Number: 5,890,954

[45] Date of Patent: Apr. 6, 1999

[54] FLOOR EDGERS AND SANDERS

[76] Inventor: Francis A. Barous, PO Box 40 1118 Lakeview Ave., Dracut, Mass. 01826

[21] Appl. No.: 744,621

[22] Filed: Nov. 6, 1996

[51] Int. Cl.[6] ..... B24B 23/00; B24B 27/08

[52] U.S. Cl. ..... 451/350; 451/353

[58] Field of Search ..... 451/350, 353, 451/457, 357, 354, 360; 30/374; 83/487

[56] References Cited

U.S. PATENT DOCUMENTS

| | | | |
|---|---|---|---|
| 589,006 | 8/1897 | Manning . | |
| 831,272 | 9/1906 | Fletcher . | |
| 2,507,052 | 5/1950 | Robinson . | |
| 4,069,568 | 1/1978 | Sakamoto et al. . | |
| 4,087,914 | 5/1978 | Bates | 30/374 |
| 4,233,738 | 11/1980 | De Drick | 30/374 |
| 4,334,356 | 6/1982 | Krosunger | 30/374 |
| 4,665,617 | 5/1987 | Maier et al. | 30/374 |
| 4,709,513 | 12/1987 | Tingley . | |
| 4,777,726 | 10/1988 | Flowers | 30/374 |
| 5,031,364 | 7/1991 | Belanger . | |

*Primary Examiner*—Timothy V. Eley
*Assistant Examiner*—Derris H. Banks
*Attorney, Agent, or Firm*—Vernon C. Maine; Scot J. Asmus

[57] ABSTRACT

An improvement to a rotary floor edger/sander machine for eliminating the tracks caused by the castors on the back edge of the edger when working on softer floors. Castors are replaced or supplemented with a float member assembly that provides a relatively larger area of smooth surface support. The rotating disc reduces friction between the float member and the floor, facilitating the manual guidance of the machine over the floor. The float member assembly can also be configured so as to reduce the overall opening between the machine's bellhousing and the floor, increasing the effectiveness of the machine's vacuum action for picking up loosened particles of floor material.

18 Claims, 7 Drawing Sheets

FLOOR EDGERS AND SANDERS

BACKGROUND OF THE INVENTION

TECHNICAL FIELD OF THE INVENTION

This invention most generally relates to powered, rotating disk surface conditioning tools. More particularly, it relates to rotary floor edgers and sanders for sanding or finishing floor surfaces.

BACKGROUND OF THE INVENTION

FIG. 1 shows a perspective upper side view of a floor edger 10 of the prior art. Floor edger 10 is an electrically powered, handheld, rotary floor conditioning tool. It has a motor housing 11 which houses an electric motor and fan. A pair of handholds 12 are attached on opposing sides of motor housing 11. Power cord 13 and dust bag 14 are likewise attached to the motor housing at other than the front side.

Bell housing 15 is a circular metal skirt firmly attached to the lower end of motor housing 11, which encloses a motor-driven rotor head and circular sanding disc. The rotating sanding disc has a metal casing 16. The disc and casing protrude somewhat through a closely conforming opening in the front of the bell housing. The sanding disc is configured to accept the attachment of disposable, circular sandpaper sheets. The geometry of the machine enables the rotating disc with it's sandpaper sheet to contact the floor, and to be maneuvered up close to baseboards and walls.

The bell housing protects the operator from accidental contact with the revolving disc and provides a shroud through which dust and particulate matter loosened by the sanding operation can be drawn upward by the fan and forced into the dust bag.

Castor assembly 17 is attached to the rear of bell housing 15. Relatively small, steel-wheeled castors 17A and 17B are adjusted to a height slightly lower than the plane of the sanding disc, placing a portion of the weight of the edger on the rollers and effectively tilting the edger forward slightly so that only the forward portion of the disc contacts the floor. The total area of contact is an arc of somewhat less than 90 degrees (90°) at the front edge of sander 10. The total weight of the edger is then distributed between the front edge of the sanding disc and the pair of castors.

The operator grasps the two handles and engages a trigger switch. The edger "floats" on the rotating disc and castor assembly, it's lateral movement and sanding effects being controllable by a skilled operator. The handles and castors function as a lever and fulcrum by which the weight of the edger bearing on the front edge of the sanding disc is continuously adjusted or controlled by the operator while the edger is being moved along the edge of the floor. A larger, standup floor sander is typically used to prepare the center section of the floor, overlapping with the area prepared by the edger.

The steel castor assembly 17 exhibit low coefficients of static and kinetic friction on hard floor surfaces, allowing the edger to be maneuvered without excessive effort by the operator. The span or relative distance of one castor from the other is normally at least greater than the radius of the sanding disc in order to provide stability against "tipping" the edger from side to side, which would make the edger difficult to operate and might cause the bell housing to contact the floor. Small castors swivel to the new orientation over a relatively short distance when the direction of the edger is changed. This minimizes the wobble that larger castors would cause to a vehicle's path when changing direction as they swivel to the new orientation.

However, there is a problem with small castors due to the very small area of tangential contact with the floor. The size of the small, narrow wheels or castors commonly found on a 30 pound or heavier floor edger/sander machine is less than one inch in diameter and three quarters of an inch wide. A pair of such castors or wheels rolling on pine or spruce on the back edge of a typical rotary floor edger is estimated to have a surface contact area or footprint of less than one eighth square inch.

A substantial portion of the full weight of the edger, industrial edgers typically weighing 30 pounds or more, is continuously bearing on or forcing the castors into the floor surface. This concentration of weight on the small castors produces a castor track in the flooring, particularly in the softer woods such as pine and spruce. Additional work must then be done in order to eliminate the castor tracks.

There is also another problem. The efficiency of the bell housing as a vacuum shroud in the edger of the prior art is less than optimal as it must be elevated sufficiently above the plane of the sanding disc on all sides to insure that it does not contact the floor surface and cause damage. The available suction is distributed over the full perimeter of the gap, and some degree of loose matter inevitably escapes, contributing to dust in the air breathed by the operator or remaining as loose material on the floor.

SUMMARY OF THE INVENTION

The invention, in it's simplest form, is an improvement to a floor edger/sander, and other similarly configured surface conditioning tools, whereby the castors are replaced with or supplemented by a structure of selected properties which eliminates the tracks caused by castors when operated on surfaces of relatively soft material such as spruce and pine.

The coefficients of friction, or "non-stick" properties, for nylon and similar plastic materials is known to be low. A smooth, flat nylon surface slides readily on a smooth support surface when the compression or weight is evenly distributed and does not deform either surface. Also, the surface hardness of nylon and most other plastics, is much less than stainless steel or other metals used in the fabrication of machine castings and parts.

A circular surface area of one inch diameter will exceed the minimal contact area of the castors of the prior art. An elongated surface area of about eight by three quarters of an inch is well in excess of the footprint or surface contact area of a pair of such castors.

The spinning of the disc in a powered floor edger or similar tool essentially eliminates the effects of static friction between a supporting member under uniform weight distribution and the flat surface upon which it bears. This makes it relatively easy to initiate lateral movement or change direction of movement of the tool.

It is therefore a goal of the invention to provide a casterless float assembly that may be attached to the backside of a floor edger for use on a floor, that will reduce or eliminate the caster tracks of the prior art. To that end, the invention has a smooth flat total surface area of greater than one and one half square inches to contact and slide over the floor and support the back edge weight of the edger in operation.

It is a further object of the invention that it may be used in conjunction with the conventional pair of prior art casters in order to distribute the weight and reduce the problem of caster tracks. To that end, the invention may be configured for use in combination with the casters of the prior art. Further, either the casters or the float member may be spring-loaded to assure uniform weight distribution as between them.

It is a yet further object of the invention that it enhance the efficiency of the vacuum action by which loose particles of floor material are sucked into a vacuum bag. To this end, the invention may be configured to reduce or close a portion of the air gap between the edger's bell housing and the floor, accelerating the airflow through the remaining gap.

It is a still yet further objective of the invention to provide a means by which the contact surface of the float assembly may readily conform to the plane of the floor. To this end, a means for omni-directional or bi-directional tilting of the contact surface with respect to the edger may be incorporated in the assembly.

Still other objects and advantages of the present invention will become readily apparent to those skilled in this art from the following detailed description, wherein I have shown and described only the preferred embodiment of the invention, simply by way of illustration of the best mode contemplated by me of carrying out my invention.

DESCRIPTION OF THE PREFERRED EMBODIMENT

To those skilled in the art, the invention admits of many variations. The following is a description of a preferred embodiment, offered as illustrative of the invention but not restrictive of the scope of the invention.

Figure 2:
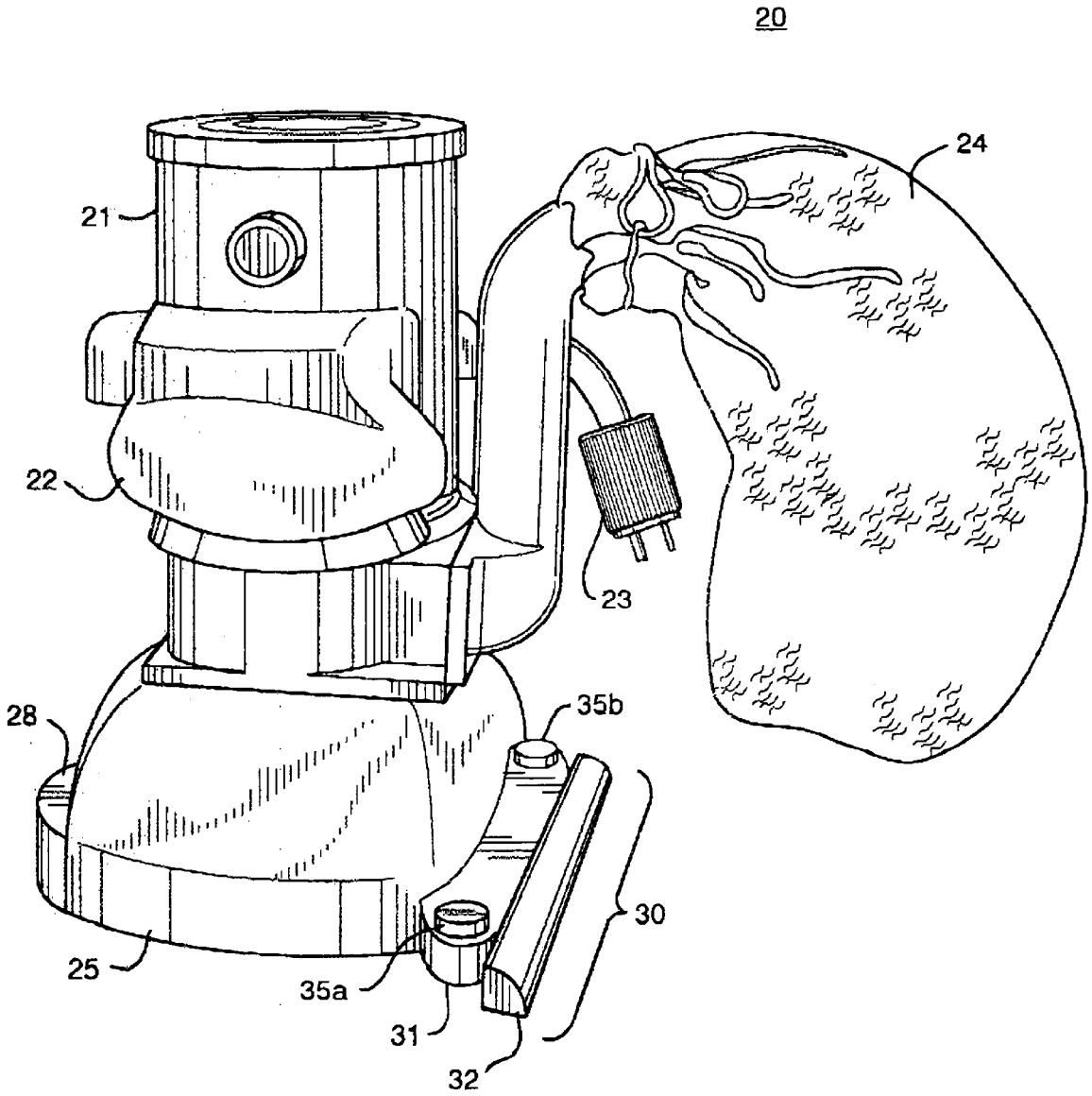
FIG. 2 is an upper left side perspective view of a preferred embodiment of the invention.

Referring to FIG. 2, floor edger 20 is an electrically powered, handheld, floor sanding tool. It has a motor housing 21 which houses an electric motor and fan. A pair of handholds 22 are attached on opposing sides of motor housing 21. Power cord 23 and dust bag 24 are likewise attached to the motor housing at other than the front side.

Figure 3:
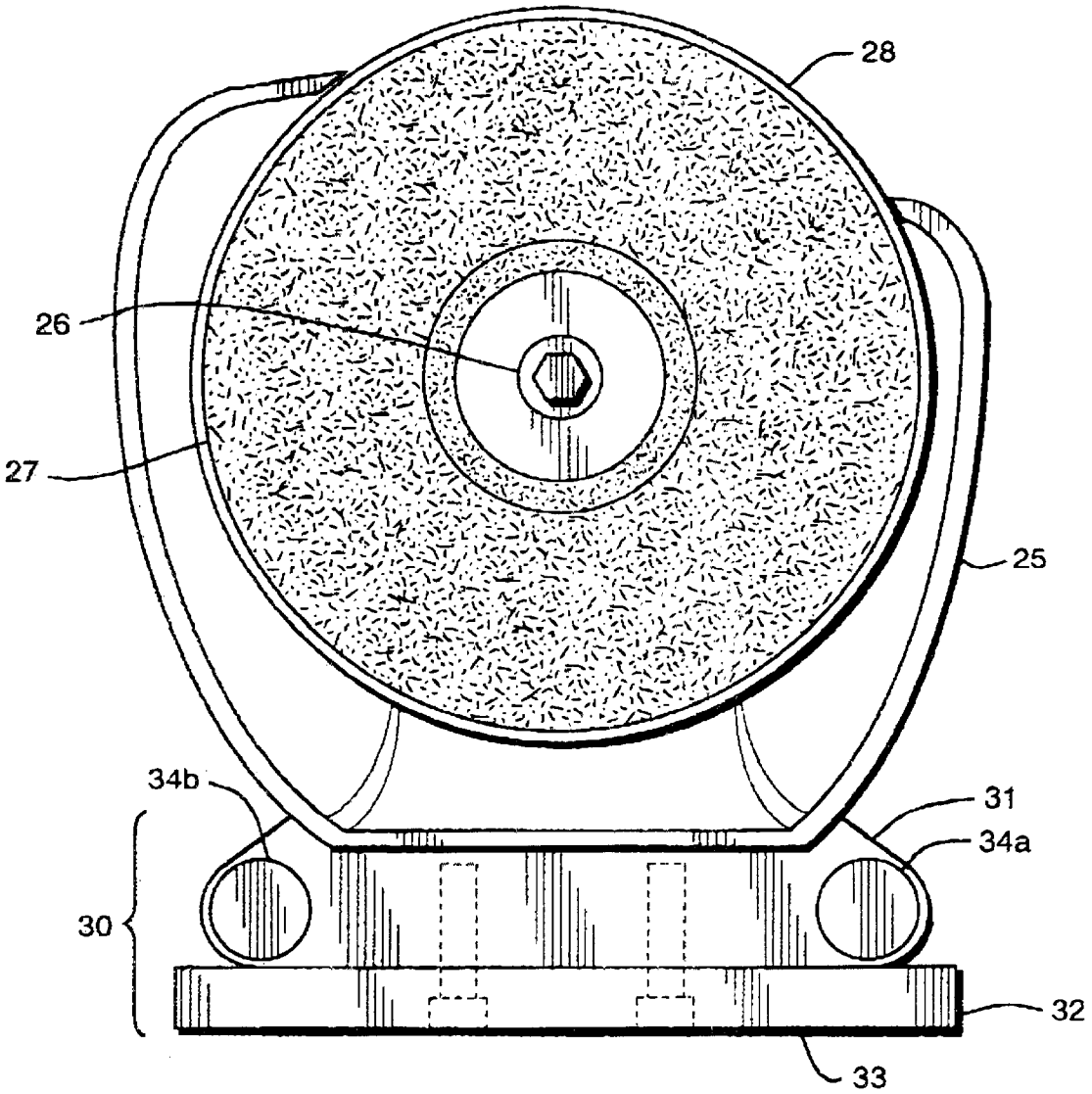
FIG. 3 is a bottom view of the embodiment of FIG. 2.

Referring to FIGS. 2 and 3, bell housing 25 is a circular metal skirt firmly attached to the lower end of motor housing 21, enclosing rotor head 26 to which is attached sanding disc 27 and disc casing 28. Sanding disc 27 and casing 28 protrude very slightly below and out in front of bell housing 25 to enable contact of the disc with the floor and use of the edger up close to baseboards and other obstructions on the floor.

Float bar assembly 30 is attached to the rear of bell housing 25. The assembly consists of elongate mounting bracket 31 and elongate nylon float bar 32. Bracket 31 is configured to mate closely and securely in a horizontal orientation with, and is attached by conventional hardware to, the rear lower edge of bell housing 25.

Bracket 31 is configured near each end with vertically oriented, threaded bores 34A and 34B of about one inch diameter. Threaded studs 35A and 35B have slotted top ends and substantially flat bottom ends. The studs are made from the same nylon material as float bar 32, sized for a snug friction fit within respective bores 34A and 34B which resists rotation except under the added torque of a screwdriver or similar tool.

Figure 4:
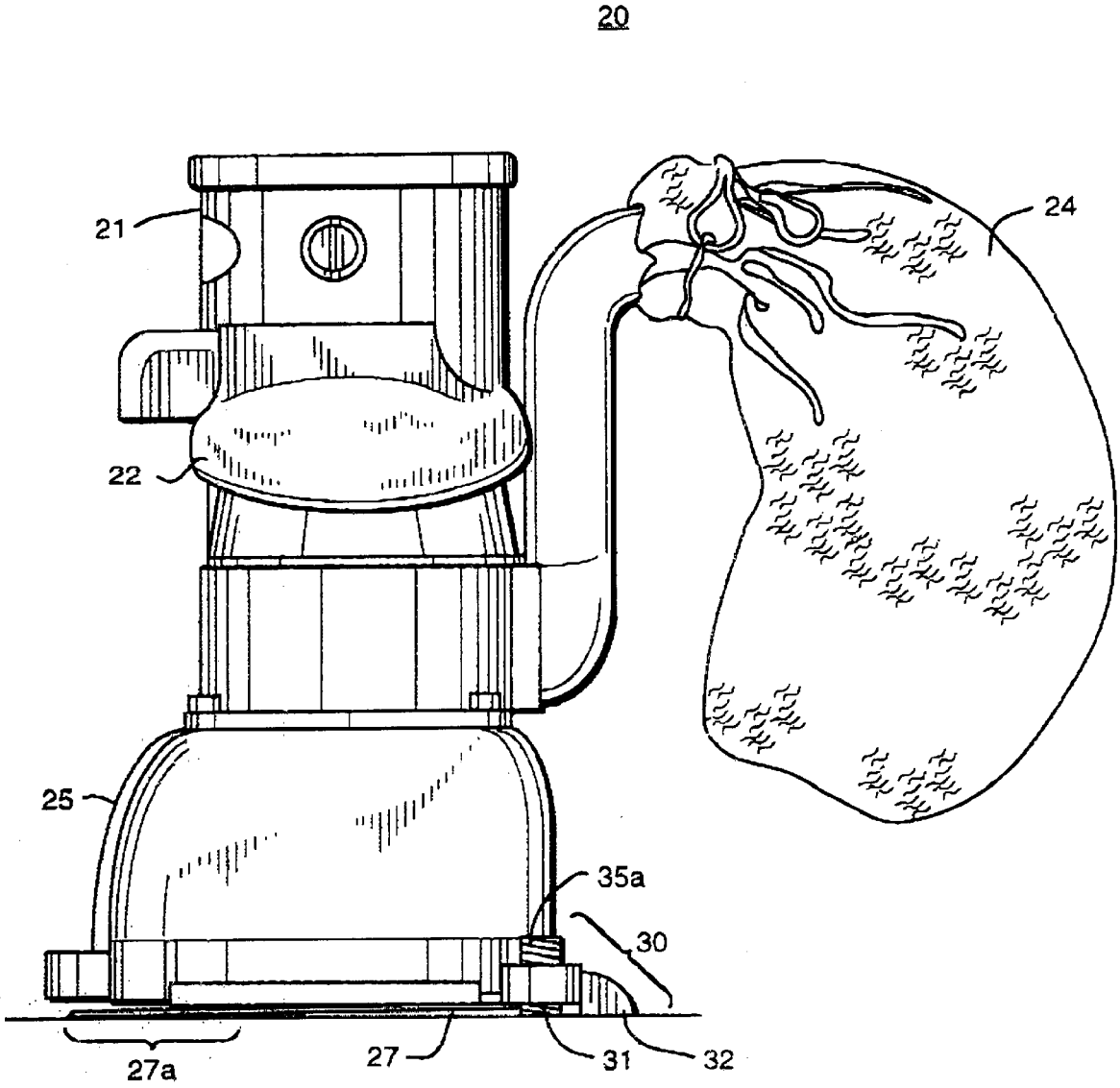
FIG. 4 is a left side elevation of the embodiment of FIG. 2.
Figure 5:
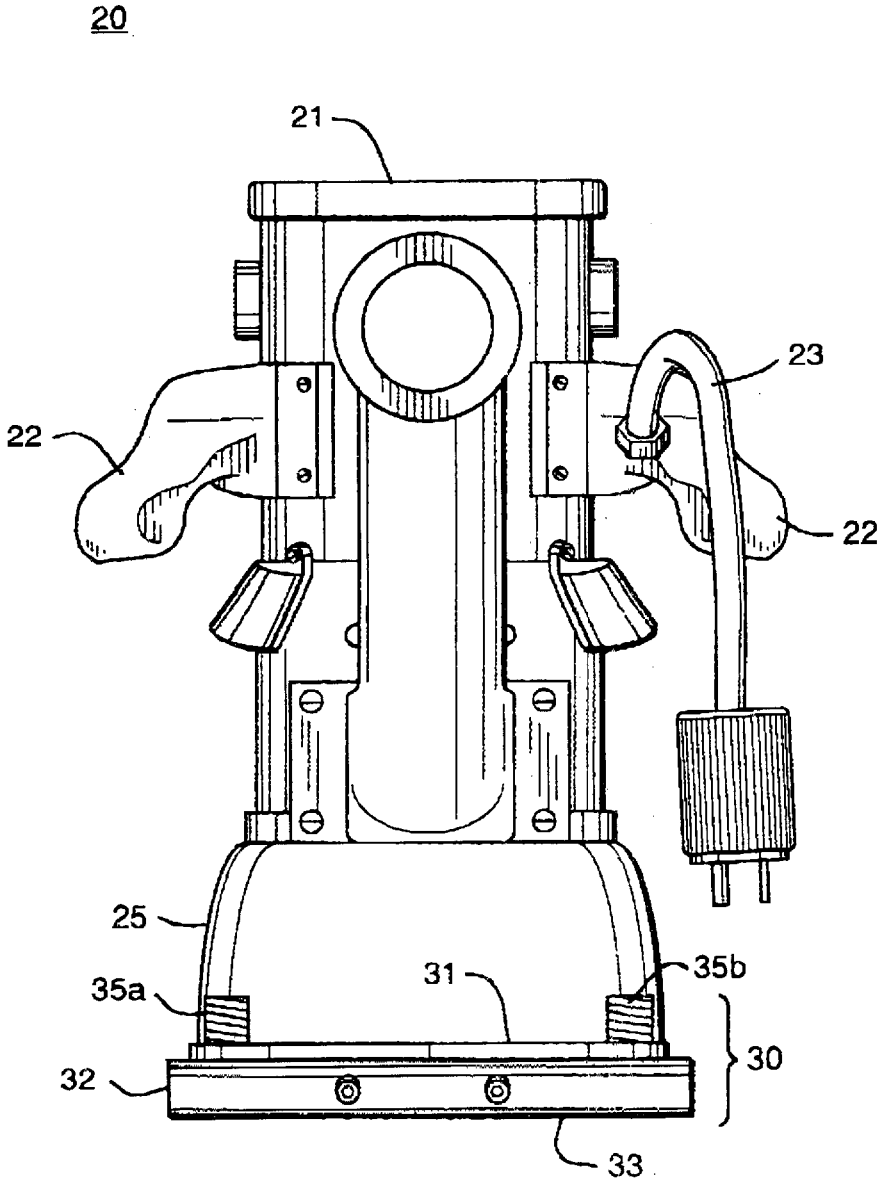
FIG. 5 is a backside elevation of the embodiment of FIG. 2.

Referring to FIGS. 4 and 5, The rear face of bracket 31 is configured to mate with the forward face of float bar 32. Float bar 32 is attached by conventional hardware to bracket 31 with an orientation that places the contact surface 33 of float bar 32 slightly below the plane of sanding disc 27, effectively tilting the edger forward slightly as it sits on the floor so that only the forward portion of the disc contacts the floor in region 27A.

Studs 35A and 35B are configured to contact the floor with about equal or greater pressure than float bar 32, the studs and floater thus supporting a portion of the weight of the edger in the region of 30A.

Figure 1:
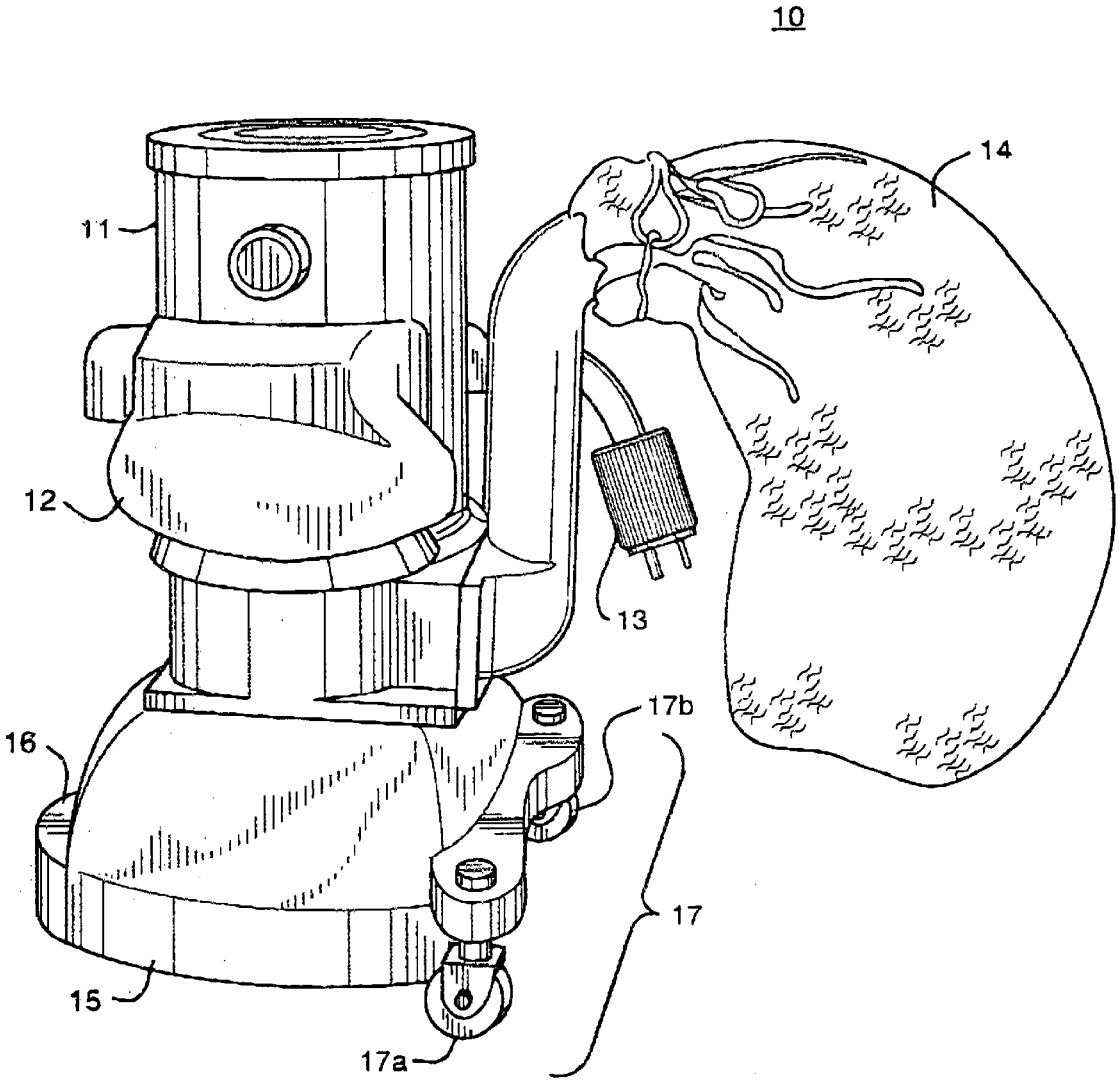
FIG. 1 (PRIOR ART)
FIG. 1 is an upper left side perspective view of a floor edger of the prior art.

This results in substantially the same overall geometry of the edger to the floor as the castors create on the prior art edger of FIG. 1, except that the surface area 30A is much larger than the effective footprint of the castors of the prior art.

The length of floatbar 32 and it's surface 33 is approximately the same as the diameter of sanding disc 27. The lateral spacing of studs 35A and 35B is approximately the same as the diameter of the disc. The width of surface 33 is less than ¾ inch. Surface 33 is configured with a slight convex curvature, of radius more than twice it's width, extending from it's front edge to it's back edge.

Bracket 31 and floatbar 32 in combination, when mounted as shown on the rear or back edge of bell housing 25, results in a closing or reduction of a portion of the gap between bell housing 25 and the floor, as compared to prior art edger 10 in FIG. 1.

In operation, the rotating disc of edger 20 reduces both static and kinetic friction between floatbar 32 and studs 35, and the floor. The lateral orientation of floatbar 32 presents an end view or small frontal area to the normal side to side motion of the edger in operation.

The surface area of studs 35, particularly in combination with float bar 32, provides sufficient surface area to support the edger on floors of softer woods without causing a noticeable or permanent deformation or track. The full span of bracket 31 and floatbar 32 reduces the perimeter gap to which the edger's vacuum power is applied, thus increasing the effectiveness of the vacuum feature for picking up loosened particles of floor material.

The height and angle of floatbar 32 with respect to the plane of sanding disc 27 is adjustable for variations in setup and operation.

Figure 6:
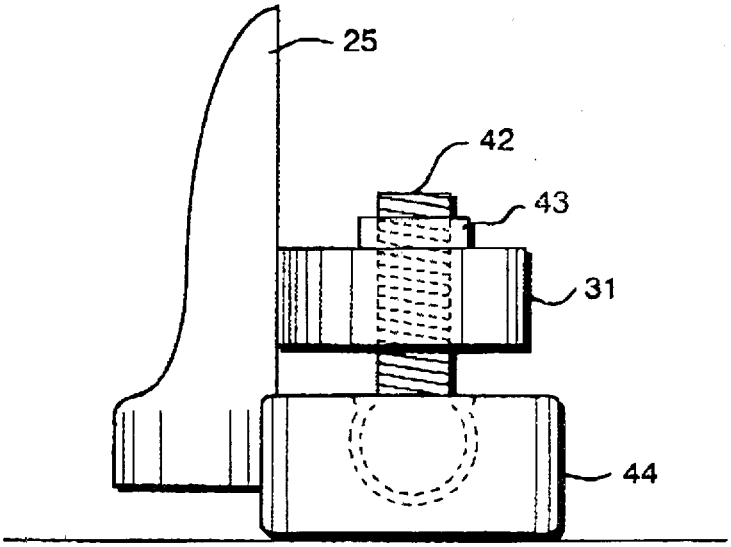
FIG. 6 is a left side elevation of a circular float member attached to a bracket by means allowing for omni-directional tilting of the float member.

Referring now to FIG. 6, an alternative assembly to either of studs 35A and 35B of FIGS. 2–5 consists of two each of threaded ball end stud 42, nut 43 and circular float member 44, similarly laterally displaced and mounted in threaded bores in bracket 31. The upper end of stud 42 is slotted to provide for vertical adjustment in bracket 31. The diameter of float member 44 is one inch, the same as studs 35A and 35B. A hole in the top center of member 44 is sized for a compressible fit and retention over the ball end of stud 42.

The material of member 44 is the same as studs 35A and 35B. This configuration provides for omnidirectional tilting of the float member 44 to continuously conform to the plane of the floor.

Figure 7:
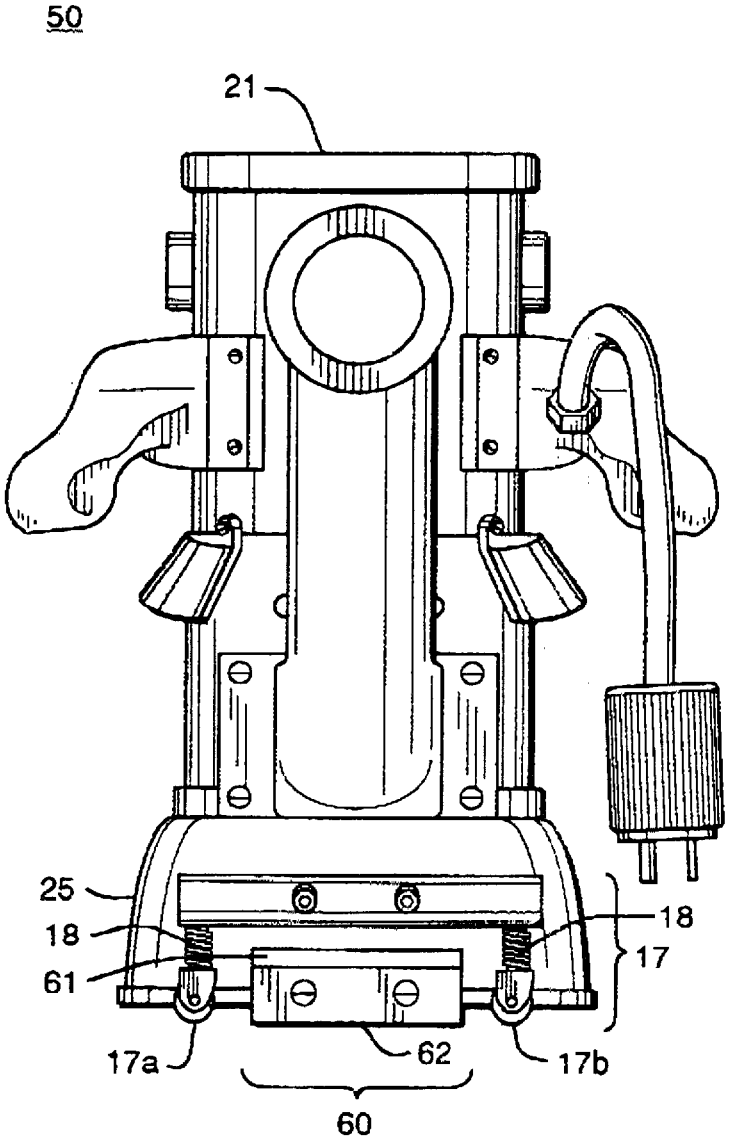
FIG. 7 is a backside elevation of an elongate float member in combination with a pair of castors, attached to the back edge of a floor edger.

Referring to FIG. 7, edger 50 is configured with caster assembly 17 of FIG. 1 in combination with float assembly 60, where elongate float member 62 is attached to bracket 61, assembly 60 being sufficiently short to avoid interference with the directional rotation of casters 17A and 17B, and attached to edger 60 between them. Float member 62 and castors 17A and 17B are vertically adjusted so that casters 17A and 17B and float member 62 all contact the floor in normal operation. Springs 18 the provide for vertical compression of the casters, and are preloaded to provide for proper weight distribution between the casters and the float member over uneven floors.

Many other variations of the invention within the scope of the appended claims are possible. As an example, there may be a float assembly that is attachable to the backside of a rotary floor edger/sander, the assembly having one or more float members that all have substantially flat and smooth floor contact surfaces where the total area is significantly greater than the surface area of support offered by a pair of small castors. One and one half square inches may be a practical minimum for backside surface area contact and sliding support for a floor edger machine weighing in the order of 30 pounds.

As another example, the assembly may be used in lieu of or in conjunction with the conventional castors of the prior art.

As a further example, the assembly may include a bracket that is attachable to the backside of the edger, with an elongated floatbar or float member attached to the bracket. This embodiment may be used in lieu of or in conjunction with the conventional castors of the prior art.

As a yet further example, the assembly may have a pair of float members arranged with a lateral displacement of about the same distance as the edger is wide. The float members may be individually vertically adjustable as to the edger, or more particularly, to the plane of the rotating sanding disc. This would allow for adjustments to the geometry of the edger as it sits on the floor. These float members may be in the form of threaded studs mounted in vertically oriented threaded bores in the bracket.

As an additional example, the assembly may combine the pair of vertically adjustable, laterally separated float members with the elongated float member.

As another additional example, any or all of the float members may be attached or mounted to the bracket or the edger by means allowing the float member to tilt freely in a bi-directional or omnidirectional sense to continuously conform the angle of it's contact surface to the plane of the floor. This means may be in the form of a ball and socket joint or a hinge joint between the float member and the bracket.

As yet another additional example, any or all of the float members may be made from material other than steel or other hard metals or machine alloys; materials having a lower durometer or hardness quality and to which a smooth surface can be applied, thereby being less likely to damage common floor materials such as wood, when used in the specified manner. Nylon or other plastics are among the materials that may be used.

As a further example, some float members may be spring-loaded in their mounting arrangements, thus allowing for vertical compression to accommodate variations in floor surface and angle of machine/floor interface while maintaining a consistent weight distribution as between float members.

As yet another further example, where the improvement is used in combination with castors, the castors may be spring-loaded in their mounting arrangements, thus allowing for vertical compression to accommodate variations in floor surface and angle of machine/floor interface while maintaining a consistent weight distribution as between the castors and the float members.

All embodiments of the invention help to reduce or eliminate the occurrence of caster tracks in the floor surface of materials too soft to support the casters of the prior art.

As will be realized, the invention is capable of other and different embodiments than are presently illustrated, and its several details are capable of modifications in various obvious respects, all without departing from the invention. Accordingly, the drawing and description are to be regarded as illustrative in nature, and not as restrictive.

I claim:

1. An improvement to a floor edger with a rotatable circular sanding disk and a bell housing, a working edge of said circular sanding disk partially extending from under a front edge of said bell housing, a motor housing atop said bell housing containing a motor connected to said sanding disk, and a set of operator handles attached to said motor housing, comprising:

a casterless float assembly for bearing on said floor surface as a sliding fulcum upon which said floor edger is balanced by operator control exerted on said handles to control contact pressure of said one edge of said circular sanding disk on said floor surface, said casterless float assembly attachable to said bell housing at a point generally opposite said front edge and spaced substantially apart from said working edge of said sanding disk, said float assembly having one or more float members, each said member having a substantially flat and smooth floor contact surface, the total area of all said floor contact surfaces being greater than one and one half square inches.

2. The improvement of claim 1, said assembly comprising a bracket attachable to said floor edger and an elongate float member attached to said bracket.

3. The improvement of claim 2, said assembly being used in conjunction with castors.

4. The improvement of claim 2, said assembly further comprising two float members attached thereto with a lateral displacement of about the width of said floor edger, said two float members being individually vertically adjustable with respect to said floor edger.

5. The improvement of claim 1, said assembly comprising a bracket and means for attaching said bracket to said floor edger, said bracket having two float members attached thereto with a lateral displacement of about the width of said floor edger, said two float members being individually vertically adjustable with respect to said floor edger.

6. The improvement of claim 1, said float members incorporating ball and socket joints for self alignment with said floor surface.

7. The improvement of claim 1, at least one of said float members being attached by means allowing for vertical compression.

8. The improvement of claim 1, said castors being attached by means allowing for vertical compression.

9. A floor edger for conditioning a floor surface comprising a rotatable circular sanding disk and a bell housing, a working edge of said circular sanding disk partially from under a front edge of said bell housing, a motor housing atop said bell housing containing a motor connected to said sanding disk, a set of operator handles attached to said motor housing, and a casterless float assembly for bearing on said floor surface as a sliding fulcum upon which said floor edger is balanced by operator control exerted on said handles to control contact pressure of said one edge of said circular sanding disk on said front edge and spaced substantially apart from said working edge of said sanding disk, said float assembly having one or more float members, each said member having a substantially flat and smooth floor contact surface, the total area of all said floor contacts surfaces being greater than one and one half square inches.

10. The improvement of claim 9, said assembly being used in lieu of castors.

11. The improvement of claim 9, said assembly being used in conjunction with castors.

12. The improvement of claim 11, said castors being attached by means allowing for vertical compression.

13. The floor edger of claim 9, said float assembly comprising a bracket attached to said floor edger and an elongate float member attached to said bracket.

14. The improvement of claim 13, said assembly being used in conjunction with castors.

15. The improvement of claim 13, said assembly further comprising two float members attached thereto with a lateral displacement of about the width of said floor edger, said two float members being individually vertically adjustable with respect to said floor edger.

16. The improvement of claim 9, said assembly comprising a bracket and means for attaching said bracket to said floor edger, said bracket having two float members attached thereto with a lateral displacement of about the width of said floor edger, said two float members being individually vertically adjustable with respect to said floor edger.

17. The floor edger of claim 9, said float members incorporating ball and socket joints for self alignment with said floor surface.

18. The improvement of claim 9, at least one of said float members being attached by means allowing for vertical compression.

* * * * *